US006161745A

United States Patent [19]

Grazioli et al.

[11] Patent Number: 6,161,745

[45] Date of Patent: Dec. 19, 2000

[54] POWDER FORCE-OPERATED SETTING TOOL

[75] Inventors: Mario Grazioli, Chur, Switzerland; Gebhard Gantner, Nenzing, Austria; Sybille Renner, Grabs, Switzerland

[73] Assignee: Hilti Aktiengesellschaft, Liechtenstein

[21] Appl. No.: 09/352,598

[22] Filed: Jul. 13, 1999

[30] Foreign Application Priority Data

Jul. 13, 1999 [DE] Germany ..... 198 31 053

[51] Int. Cl.[7] ..... B25C 1/04

[52] U.S. Cl. ..... 227/10

[58] Field of Search ..... 227/9, 10, 11, 227/130

[56] References Cited

U.S. PATENT DOCUMENTS

| | | | |
|---|---|---|---|
| 3,050,732 | 8/1962 | Termet | 227/10 |
| 3,399,817 | 9/1968 | Diehl | 227/10 |
| 3,584,695 | 6/1971 | Turnbull | 227/10 |
| 5,114,064 | 5/1992 | Jochum et al. | 227/9 |
| 5,653,370 | 8/1997 | Bereiter et al. | 227/10 |
| 5,732,869 | 3/1998 | Hirtl | 227/10 |
| 5,797,534 | 8/1998 | Almeras et al. | 227/130 |

*Primary Examiner*—Scott A. Smith
*Attorney, Agent, or Firm*—Brown & Wood, LLP

[57] ABSTRACT

The powder force-driven setting tool including a piston guide (1) having cartridge-receiving seat (3), a discharge channel (4) and a bore (2) in which a drive piston (5) is displaceable parallel to the setting direction, the cartridge-receiving seat (3) and discharge channel (4) opening into the bore (2), a sealing region (6) is formed by the drive piston (5) and the piston guide (1). between the mouth of the cartridge-receiving seat (3) and the discharge channel (4).

5 Claims, 2 Drawing Sheets

POWDER FORCE-OPERATED SETTING TOOL

BACKGROUND OF THE INVENTION

1. Field of Invention

The invention relates to a powder force-operated setting tool including a piston guide having a bore a cartridge-receiving seat, and a discharge channel, with the cartridge-receiving seat and the discharge channel opening into the guide bore, and a drive piston displaceable in the guide bore.

2. Description of the Prior Art

When fastening elements are driven with a setting device into materials having different hardness and strength, the resistance, which has to be overcome, varies. There is therefore a need for adapting the driving-in power of the setting tool to local conditions. EP-0 330 950 discloses a setting tool in which propellant charges of uniform hardness are used. The different driving-in powers is controlled by a power regulating device provided on the equipment. The piston guide of this known setting equipment a bore, in which a driving piston reciprocates parallel to the setting direction. A cartridge-receiving seat and a discharge channel, the cross-section of which can be changed by a regulating pin, open into the guide bore. In this known setting tool, since the discharge channel opens immediately after the driving piston is started by the ignition of a cartridge, the pressure of the driving gas partially decreases before it has built up completely.

It is therefore an object of the present invention to provide a powder force-operated setting tool, which can be manufactured economically and for which a decrease in the pressure of the driving gas immediately after the driving piston is started is prevented, and the discharged channel opens only when the driving piston has been shifted in the setting direction a certain amount.

SUMMARY OF THE INVENTION

This and other objects of the present invention, which will become apparent hereinafter, are accomplished by providing a powder force-operated setting tool in which a sealing region is formed between the opening of the cartridge-receiving seat and the month of the discharge channel by the piston guide and the piston.

As a result, in the inventive setting tool, the discharge channel does not open immediately at the start of movement of the driving piston in the setting direction Instead, it opens up only when the driving piston, after having been displaced a certain amount in the setting direction, releases the sealing region and connects the cartridge-receiving seat with the discharge channel.

For manufacturing reasons, the sealing region preferably is formed by the inner wall of a cylindrical depression in a stop face of the piston guide facing in the setting direction, and the outer wall of a shoulder of a counter-surface of the drive piston facing in a direction opposite to the setting direction, the cartridge-receiving seat opening into the cylindrical depression and the discharge channel in the stop face opening into the bore of the guide member.

Preferably, the shoulder is cylindrically-shaped. This means improves sealing properties of the sealing region.

In setting tools, in which drive pistons with two large pressure stages are used, the stop face preferably forms part of a cylindrical projection which, in the setting direction, protrudes from a bottom of the piston guide, which is directed in the setting direction, with the counter-surface of the drive piston being part of a cylindrical recess which is spaced from a free end of the drive piston and faces in a direction opposite to setting direction, and the diameter of the cylindrical projection and of the cylindrical depression are essentially equal to each other.

Because the cylindrical shoulder of the drive piston protrudes, in the starting position of the drive piston, completely into the cylindrical depression of the piston guide, the distance between the bottom and the stop face of the piston guide advantageously is larger than the distance between the counter-surface and the free of the driving piston.

In order to be able to change the further acceleration of the drive piston setting tool, the cross-sectional area of the discharge channel advantageously can be changed by regulating means. The regulating means is, for example, formed as a borehole, which passes essentially vertically through the discharge channel and in which a regulating pin is movably disposed.

BRIEF DESCRIPTION OF THE DRAWINGS

The invention will how be explained in greater detail with the reference to the drawings, showing an embodiment example of the invention. In the drawings.

RETAILED DESCRIPTION OF THE PREFERED EMBODIMENT

Figure 1:
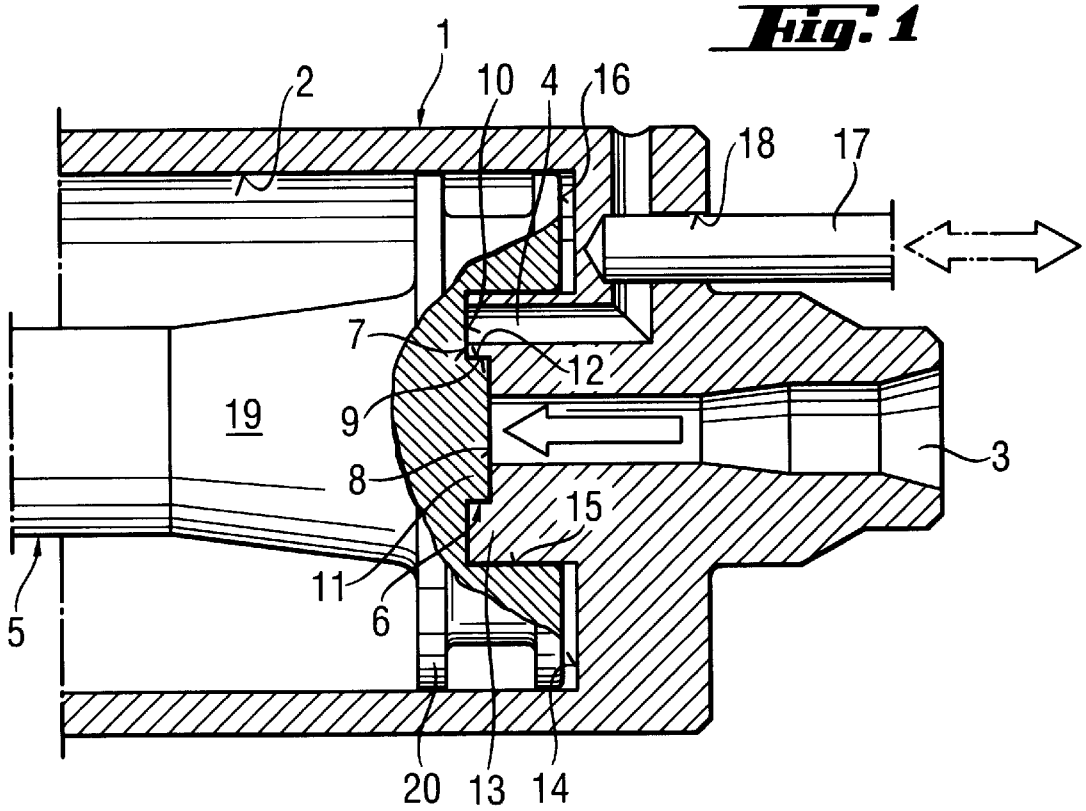
FIG. 1 shows a cross-sectional view of a piston guide in conjunction with a drive piston of an inventive, powder force-operated setting tool, with the drive piston being in its starting position and adjoining at the opening of the cartridge seat.
Figure 2:
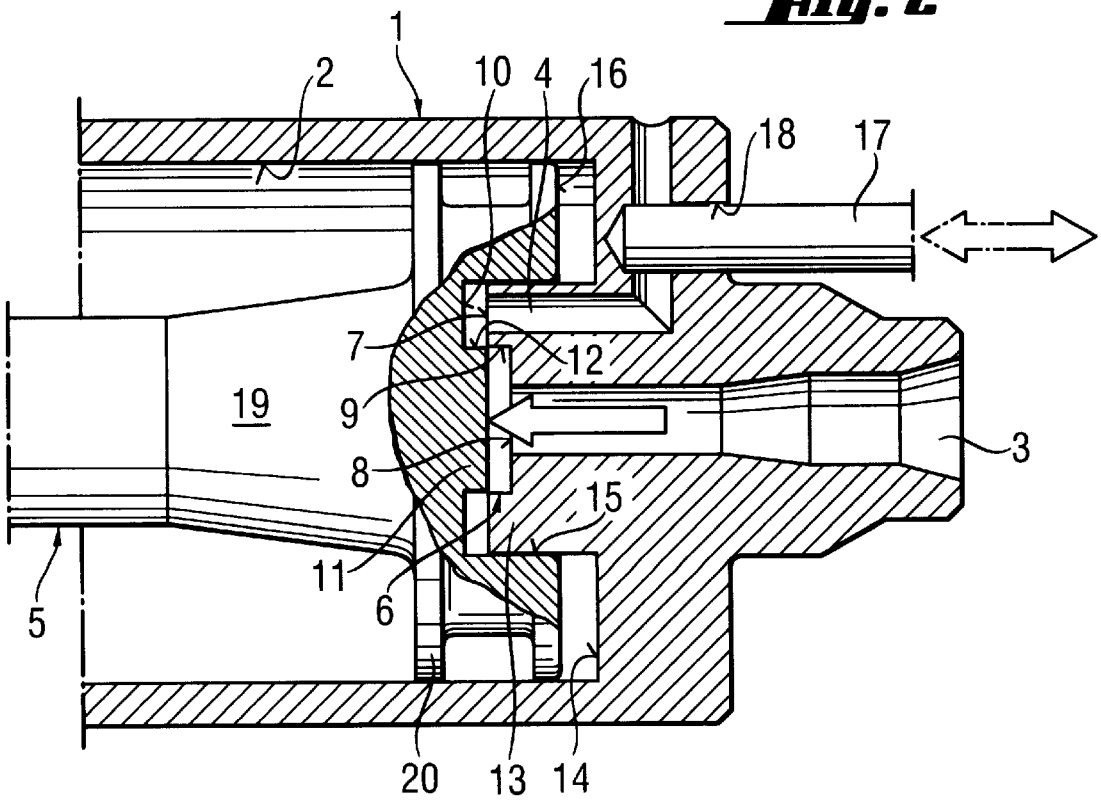
FIG. 2 shows a cross-sectional view of the setting tool of FIG. 1 with the drive piston being spaced from the mouth of the cartridge-receiving seat and sealing the cartridge receiving seat from the discharge channel.
Figure 3:
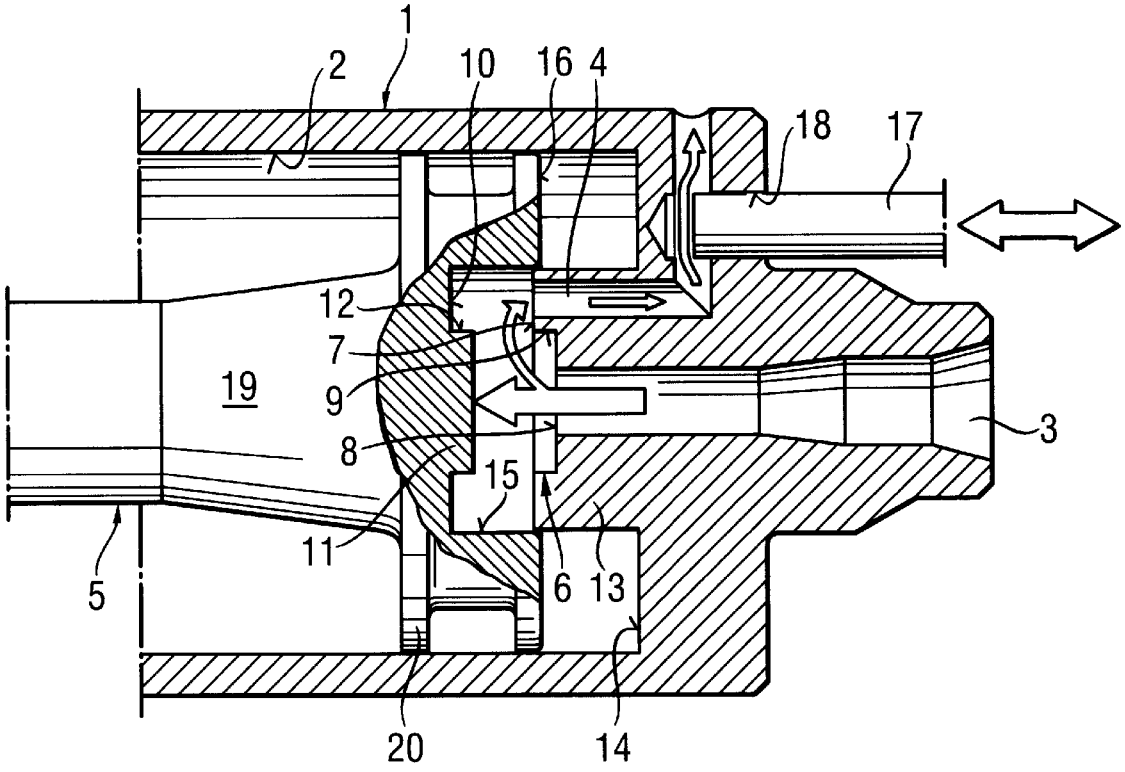
FIG. 3 shows a cross-sectional view of the setting tool of FIG. 1 with the cartridge-receiving seat being connected with the discharge channel.

The piston guide 1, shown in FIGS. 1 to 3, of a setting tool, which is shown completely, has a central bore 2, in which a drive piston 5 is disposed for displacement parallel to the setting direction. The extent of the bore 2 is limited, in direction opposite to the setting direction, by a bottom 14, from which a central, cylindrical projection 13 protrudes in the setting direction with a stop surface 7 on the setting direction side. In the central region of the stop surface 7, a cylindrical depression 8, which extends counter to the setting direction, is formed. The diameter of the projection 13 is smaller than the internal diameter of the barrel bore 2.

The piston guide 1 also has a cartridge-receiving seat 3, the cross-section, which expand in a direction opposite to the setting direction and with a connecting channel to the bore 2, the connecting channel opening in the central region of the cylindrical depression 8 into the bore 2. The piston guide 1 also has a discharge channel 4 connected with the atmosphere. A section of the discharge channel 4 in the stop surface 7 of the piston guide 1, which extends parallel to the setting direction, opens into the bore 2. A borehole 18, which accommodates and guides a regulating pin 17, which can be shifted parallel to the setting direction, and with the help of which the cross-sectional area of the discharge channel 4 can be changed, passes through the section of the discharge channel 4, extending perpendicularly to the setting direction, On the setting direction side, the drive piston 5 has a shaft 19 and, connected therewith, a flange-like sealing part 20, with a free end 16 facing in a dire opposite to the setting direction. Starting out from the free end 16, a cylindrical recess 15, with a counter surface 10 forming the base of the recess 15, extends in the setting direction in the central region of the drive piston 5. From this counter surface 10, a cylindrical shoulder 11 protrudes, the diameter of which is smaller than an internal diameter of the cylindrical depression 8 and essentially of the same size as the diameter of the cylindrical depression 8 provided in the piston guide. The extent of this cylindrical depression 8 and of the cylindrical shoulder 11 parallel to the setting direction are essentially equal in magnitude.

A cylindrical sealing region 6, extending between the opening of the cartridge-receiving seat 3 and the discharge channel 4 parallel to the setting direction, is formed by the cylindrical depression 8 and the cylindrical shoulder 11, the inner wall 9 the cylindrical depression 8 and the outer wall 12 of the cylindrical shoulder 11 together forming interacting sealing surfaces.

The initial acceleration of the drive piston can be varied by the extent of sealing region. The extent of the sealing region parallel to the setting direction is, for example, 0.2 to 8 mm.

The further acceleration of the drive piston in the setting direction, which follows the initial acceleration, can be varied by the diameter of the discharge channel The smaller the diameter of the discharge channel, the greater is the further accelerate of the drive piston. The diameter of the discharge channel is, for example, from 1.5 to 7 mm.

The function of the sealing region is described below.

In the case of the inventive setting tool, the entire driving gas pressure ignited cartridge, which is not shown, is used for the initial acceleration of the drive piston 5. For this purpose, the driving gases initially act on the end face facing opposite to the setting direction, of the cylindrical shoulder protruding from the drive piston. Only after the cylindrical shoulder 11 has left the cylindrical depression 8, is a connection formed between the cartridge-receiving seat 3 and the discharge channel 4, so that the pressure of the driving gas can be controlled.

What is claimed is:

1. A powder force-driven setting tool, comprising a piston guide having a bore (2), a cartridge-receiving seat (3), and a discharge channel drive piston (5) displaceable in the bore (2) of the piston guide (1) parallel to a setting direction; and a cylindrical projection (13) which protrudes in the setting direction from a bottom (14) of the piston guide (1) facing in the setting direction and which has a stop face (7) facing in the setting direction; the drive piston (5) having a cylindrical recess (15) with a counter surface (10) facing in a direction opposite to the setting direction with the counter surface (10) being spaced, in the setting direction, from a free end (16) of the drive piston (5) facing in the direction opposite to the setting direction, diameters of the cylindrical projection (13) and the cylindrical recess (15) being substantially equal in size, a mouth of cartridge-receiving seat (3) of the piston guide (1) being arranged in a region of the stop face (7), the mouth of the discharge channel (4) lying in the stop face (7), and the piston guide (1) and the drive piston (5) forming, between a mouth of the cartridge-receiving seat (3) and the mouth of the discharge channel (4), a sealing region (6).

2. The setting tool of claim 1, wherein a distance between the bottom (14) and the stop face (7) of the piston guide (1) is greater than a distance between the counter surface (10) and the free end (16) of the drive piston (5).

3. The setting tool of claims 1, wherein the cross-sectional surface of the discharge channel (4) is changeable by an adjustable regulating pin (17).

4. The setting tool of claim 1, wherein the sealing region (6) is formed by an inner wall (9) of a cylindrical depression (8) in a stop face (7) and an outer wall (12) of a shoulder (11) of a counter surface (10) of the drive pistol (5), whereby the mouth of the cartridge-receiving seat (3) opens in the cylindrical depression (8).

5. The setting tool of claim 4, wherein the shoulder (11) has a cylindrical shape.

* * * * *

UNITED STATES PATENT AND TRADEMARK OFFICE

CERTIFICATE OF CORRECTION

PATENT NO. : 6,161,745

DATED : December 19, 2000

INVENTOR(S) : Mario Grazioli, et al

It is certified that error appears in the above-identified patent and that said Letters Patent is hereby corrected as shown below:

{73} Assignee:

Hilti Aktiengesellschaft, Schaan, Liechtenstein

[30] Foreign Application Priority Data:

Jul. 13, 1998 [DE] Germany 198 31 053

Signed and Sealed this

First Day of May, 2001

*Attest:*

Nicholas P. Godici

NICHOLAS P. GODICI

*Attesting Officer*

*Acting Director of the United States Patent and Trademark Office*